8-107 SR
FIP8309 OR 4,215,990

United States Patent [19]
Barrett, Jr. et al.
[11] 4,215,990
[45] Aug. 5, 1980

[54] PEROXYGEN BLEACHING AND LAUNDERING COMPOSITIONS

[75] Inventors: John H. Barrett, Jr., La Mirada; Elizabeth F. Formeloza, Wilmington, both of Calif.

[73] Assignee: Purex Corporation, Lakewood, Calif.

[21] Appl. No.: 896,382

[22] Filed: Apr. 14, 1978

[51] Int. Cl.[2] ..... D06L 3/00
[52] U.S. Cl. ..... 8/107; 8/101; 8/111; 252/99
[58] Field of Search ..... 8/111, 107; 252/99

[56] References Cited

U.S. PATENT DOCUMENTS 3,697,217 10/1972 Maddox ..... 8/111
3,894,960 7/1975 Gray et al. ..... 252/99
3,951,838 4/1976 Jayawant et al. ..... 252/99

FOREIGN PATENT DOCUMENTS 870092 1/1953 Fed. Rep. of Germany .
1373167 11/1974 United Kingdom .
1425237 2/1976 United Kingdom .

*Primary Examiner*—A. Lionel Clingman
*Attorney, Agent, or Firm*—Cushman, Darby & Cushman

[57] ABSTRACT

Granular peroxygen bleaching and laundering compositions containing a percarbonate as a source of available oxygen are stabilized by the addition of from 0.1 to 2.0 percent of a particulate siliceous matter such as amorphous silica. To prevent caking and promote flowability of the compositions, from 0.05 to 1.0 percent corn starch, diethyl phthalate or mixtures thereof is included.

16 Claims, No Drawings

PEROXYGEN BLEACHING AND LAUNDERING COMPOSITIONS

BACKGROUND OF THE INVENTION

Peroxygen bleaching agents are useful only when the available oxygen content in the laundry wash water can be controlled. Thus, agents which provide a high, stable alkalinity are employed. U.S. Pat. No. 3,697,217 teaches the use of sodium carbonate, sodium silicate, trisodium phosphate, or a mixture thereof as an "alkalinity booster" in a bleaching composition containing sodium perborate and/or sodium monopersulfate. Similarly, U.S. Pat. No. 3,894,960 teaches the building of the sodium perborate or percarbonate by admixing with a separately prepared high sodium silicate detergent powder which also may contain an amide type activator.

Although the alkali silicates operate somewhat to stabilize the available oxygen content, their presence also appears to cause accelerated caking on storage. It appears from physical inspection of the manner in which the caking first manifests itself that the hydrous alkaline polysilicate and the percarbonate tend to produce on contact a lower melting eutectic.

German Pat. No. 870,092 teaches the use of a fumed silica to stabilize percarbonate. The process of this patent has been severely criticized in U.S. Pat. No. 3,951,838. The latter patent contends that in the German process, the silica particles have only a partially hydrated structure and are not dispersible in water to yield low viscosity, high concentration sols without the application of sufficiently high shear forces to disaggregate the particles. The German process is further criticized as being time consuming, cumbersome and costly, involving the application of excessively high quantities of energy to mechanically initiate the necessary chemical reaction to achieve dispersion.

U.S. Pat. No. 3,915,838 describes the preparation of a stabilized sodium percarbonate by the use of an aqueous sol containing 3 to 8 percent of silica having a maximum particle size of 0.1 micron. The silica is prepared by deionizing a solution of a water soluble silicate to a pH of 3 to 10 in order to deposit on the percarbonate particles from 1 to 10 percent by weight of silica based on the weight of the percarbonate. In practice this patented process requires the preparation of freshly prepared silica sols which are of necessity applied to the dry percarbonate particles as an aqueous suspension and therefore requires subsequent drying in order to arrive at a dry, free flowing product.

It is the primary object of the present invention to provide peroxygen bleaching and laundering compositions having excellent stability.

A further object of the present invention is to provide a means whereby the caking of dry granular household laundry bleaches is prevented and the flowability enhanced.

These and other objects will be apparent from the description which follows.

SUMMARY OF THE INVENTION

It has now been found that the simple admixing of appropriate quantities of certain particulate siliceous containing materials is sufficient to provide excellent stability for dry, granular, household laundry bleaches containing a percarbonate such as sodium percarbonate as a source of available oxygen against the loss of oxygen during storage.

Thus, our invention provides a novel bleaching and laundering composition containing a percarbonate and, as stabilizing agent, particulate siliceous material.

The present invention further provides a method for the stabilization of the available oxygen content of percarbonate in a granular peroxygen bleaching and laundering composition wherein the source of available oxygen consists of a percarbonate, which comprises adding to said luandering composition in an amount sufficient to stabilize the available oxygen content against the effects of humidity and temperature of a dry particulate siliceous material selected from the group consisting of aluminum silicate, magnesium-aluminum silicates, & amorphous silica.

By stabilizing the available oxygen content against the effects of humidity and temperature, one significantly inhibits the spontaneous loss of oxygen through decomposition of the percarbonate to form peroxide due to excess humidity and/or temperature.

As used herein, the term "particulate siliceous material" is to be understood as referring to siliceous materials having an average particle size ranging from 1 to 150 microns, and preferably 1 to 10 microns. Suitable siliceous materials include silicates (e.g. aluminum silicate, magnesium-aluminum silicate) and amorphous silica. Amorphous silica is preferred.

From about 0.1 to 2.0 percent by weight of the total composition of the particulate siliceous material is sufficient to stabilize bleaching and laundering compositions wherein the source of oxygen is a percarbonate such as sodium percarbonate. Unless otherwise stated herein, all percentages are by weight of the total composition.

The amorphous silica, which is preferred, may be for example silica gel, fused silica, fumed silica or inorganic glass microspheres. Such particulate siliceous materials are commercially available (e.g. Syloid 72, Syloid 244, Cabosil H, Cabosil MH, and Whitelite). Inorganic glass microspheres are available from Philadelphia Quartz (Q-Al-200). In a preferred embodiment the amorphous silica is present in amount ranging from 0.1 to 0.3%.

A further embodiment of our invention provides for the prevention of caking and promoting flowability of granular peroxygen bleaching and laundering composition by adding to the composition corn starch, diethyl phthalate or mixtures thereof in an amount sufficient to reduce caking and promote flowability of the composition. The inclusion of either or both of the materials greatly enhances the physical characteristics of the composition so as to provide a free flowing product to the consumer. One may suitably employ from about 0 to 1%, and preferably 0.4 to 0.6%, of the corn starch, or 0 to 0.5%, and preferably 0.1 to 0.3%, of diethyl phthalate. Generally, from about 0.05 to 1.0% and preferably 0.5 to 0.9% of corn starch, diethyl phthalate or mixtures thereof is sufficient to prevent caking and promote flowability of the compositions.

Thus, the present invention provides a dry granular peroxygen bleaching and laundering composition which is stabilized against the loss of available oxygen and exhibits excellent flowability composed of by weight

- 5–50%, preferably 10–30%, alkali metal percarbonate (e.g. sodium percarbonate);
- 0–24% alkali metal perborate (e.g. sodium perborate);
- 20–95% of an alkali metal carbonate (e.g. sodium carbonate), alkali metal sulfate (e.g. sodium sulfate), alkali metal chloride (e.g. sodium chloride) or mixtures thereof;

0–1 to 2.0 of a particulate siliceous material selected from the group consisting of Al & Mg-Al silicates and amorphous silica, and 0.05 to 1.0 percent of corn starch, diethyl phthalate or mixtures thereof.

In those compositions wherein the only source of available oxygen is the alkali metal percarbonate the constituents include by weight:

5 to 50 percent alkali metal percarbonate;

20 to 95 percent alkali metal carbonate, alkali metal chloride, alkali metal sulfate or mixtures thereof, and 0.1 to 2.0 of a particulate siliceous material selected from the group consisting of Al silicates & Mg-Al silicates and amorphous silica.

These compositions may include 0.05 to 1.0% corn starch, diethyl phthalate or mixtures thereof.

While the alkali metal carbonate may be present in an amount up to 95%, when present preferably from about 20 to 75% is used. Likewise, when employed from about 20 to 55% of the alkali metal sulfate is used. As for the alkali metal chloride, when present amounts ranging from about 25 to 60% are used.

The peroxygen bleaching and laundering compositions of the present invention of course may include such additional conventional components as nonionic surfactants, fluorescent whitening agents, colorant, perfume or mixtures thereof to provide a composition of suitable physical and asthetic appearance to the consumer.

A nonionic surfactant may be employed in amounts up to 5.0%, and preferably 0.03% to 1.0%, to minimize dusting and aid in dispersing any colorant or whitening agent throughout the composition. The particular choice of surfactant is not critical.

Fluorescent whitening agents may be added in amounts up to about 1.0% and preferably 0.03 to 0.06%. Likewise, up to 1.0% perfume may be included.

The peroxygen bleaching and laundering compositions may be prepared by mixing the alkali metal chloride and/or alkali metal sulfate in a conventional manner (i.e. ribbon blender). To the dry mix is then added a slurry of nonionic surfactant, fluorescent whitening agent, colorant, perfume or mixtures thereof. After mixing, one then adds alkali metal percarbonate, particulate siliceous material and any alkali metal carbonate or perborate which may be desired together with corn starch, diethyl phthalate or mixtures thereof.

The following examples are offered in an effort to more fully illustrate the invention, but are not to be construed as limiting the scope thereof.

EXAMPLE 1

Several compositions employing only sodium percarbonate as the source of available oxygen were prepared using different types of particulate siliceous material according to the proportions below:

Sodium Percarbonate—25.0%
Sodium carbonate—20.0
Sodium sulfate—24.0
Sodium chloride—30.0
Silica*—*
Nonionic surfactant—0.5
Fluorescent whitening agents—0.05
Colorant—0.05
Perfume—0.20

*Compositions were prepared containing no silica
1% Britesil (Solid sodium silicate available from Philadelphia Quartz)—as comparison
0.2% Syloid
0.2% Cabosil The compositions were packaged in a conventional box container and exposed for three days to an atmosphere of 90° F. and 90% relative humidity. The compositions were tested at the end of three days to determine loss of available oxygen and the degree of caking. The oxygen loss was determined by iodometric titration for available $O_2$. The percent cake was measured by determining the amount of composition in a box container which, when the box opening is placed at a 45° angle over a wire screen (approximately ¼ inch square openings) remains in the box as well as the clumps which do not pass through the screen. The results are set forth in Table I which demonstrates the stabilizing effects of the various aforementioned silica compounds under these conditions.

TABLE I

| Stabilizer | After 3 days @ 90° F./90% RH | |
|---|---|---|
| | % $O_2$ Lost | % Cake |
| None | 32.4 | 37 |
| 1% Britesil[x] | 11.7 | 27 |
| 0.2% Syloid | 2.5 | 0 |
| 0.2% Cabosil | 0.6 | 0 |

x-comparative example

EXAMPLE 2

A variety of dry laundry bleach compositions were prepared in like manner to those of Example 1, but the available oxygen was supplied by a combination of sodium perborate tetrahydrate and sodium percarbonate. The compositions also contained 0.5% corn starch and 0.2% diethyl phthalate as set forth in Table II below.

TABLE II

| | A-1 | A-3 | A-4 | A-5 | A-6 |
|---|---|---|---|---|---|
| Sodium perborate tetrahydrate | 16.3 | 16.3 | 16.3 | 16.3 | 16.3 |
| Sodium percarbonate | 11.6 | 11.6 | 11.6 | 11.6 | 11.6 |
| Sodium carbonate | 20.0 | 20.0 | 20.0 | 70.85 | — |
| Sodium sulfate | 20.85 | 50.85 | — | — | 30.0 |
| Sodium chloride | 30.0 | — | 50.85 | — | 40.85 |
| Silica[a] | 0.2 | 0.2 | 0.2 | 0.2 | 0.2 |
| Nonionic surfactant[b] | 0.05 | 0.05 | 0.05 | 0.05 | 0.05 |
| Fluorescent whitening agent[c] | 0.05 | 0.05 | 0.05 | 0.05 | 0.05 |
| Colorant[d] | 0.05 | 0.05 | 0.05 | 0.05 | 0.05 |
| Perfume | 0.2 | 0.2 | 0.2 | 0.2 | 0.2 |
| Corn starch | 0.5 | 0.5 | 0.5 | 0.5 | 0.5 |
| Diethyl phthalate | 0.2 | 0.2 | 0.2 | 0.2 | 0.2 |

[a]Syloid 72.
[b]Igepal CO-630 available from GAF Corporation.[c]Contains .036 percent Tenopal AMS and .014 Tenopal RBS available from Ciba Geigy.
[d]Ultramarine blue 5002 available from Whittaker Clark and Daniels

EXAMPLE 3

The compositions of Example 2 were packaged and tested in the same manner as Example 1, except that much more severe conditions were employed. The packaged compositions were exposed to a temperature of 90° F. and an atmosphere of 90% humidity for a period of one month at which time the percent cake was determined as in Example 1. The results are set forth in Table IIA below.

TABLE IIA

| Composition | % Cake |
|---|---|
| A-1 | 3 |
| A-3 | Faulty Package |
| A-4 | 4 |
| A-5 | 27 |
| A-6 | 5 |

EXAMPLE 4

Peroxygen bleach and laundry compositions containing only sodium percarbonate as the source of available oxygen were prepared as set forth in Table III in the same manner as the compositions of Example I. A number of these compositions were then subjected to the severe conditions outlined in Example 3 and the results are set forth in Table IIIA.

TABLE III

| | B-1 | B-2 | B-3 | B-4 | B-5 | B-6 | B-7 | B-8 | B-9 | B-10 |
|---|---|---|---|---|---|---|---|---|---|---|
| Sodium percarbonate | 25.0 | 25.0 | 25.0 | 23.2 | 25.0 | 25.0 | 25.0 | 23.2 | 23.2 | 23.2 |
| Sodium carbonate | 20.0 | 20.0 | 20.0 | 20.0 | 73.89 | — | — | — | 20.0 | 20.0 |
| Sodium sulfate | 23.89 | — | 53.89 | — | — | 32.0 | 36.95 | 37.78 | — | 25.25 |
| Sodium chloride | 30.0 | 53.89 | — | 55.69 | — | 42.89 | 36.94 | 37.77 | 55.55 | 30.0 |
| Silica[a] | 0.2 | 0.2 | 0.2 | 0.2 | 0.2 | 0.2 | 0.2 | 0.2 | 0.2 | 0.2 |
| Nonionic surfactant[b] | 0.038 | 0.038 | 0.038 | 0.038 | 0.038 | 0.038 | 0.038 | 0.05 | 0.05 | 0.05 |
| Flurescent whitening agent[c] | 0.037 | 0.037 | 0.037 | 0.037 | 0.037 | 0.037 | 0.037 | 0.05 | 0.05 | 0.05 |
| Colorant[d] | 0.038 | 0.038 | 0.038 | 0.038 | 0.038 | 0.038 | 0.038 | 0.05 | 0.05 | 0.05 |
| Perfume | 0.15 | 0.15 | 0.15 | 0.15 | 0.15 | 0.15 | 0.15 | 0.2 | 0.2 | 0.2 |
| Corn starch | 0.5 | 0.5 | 0.5 | 0.5 | 0.5 | 0.5 | 0.5 | 0.5 | 0.5 | 0.5 |
| Diethyl phthalate | 0.15 | 0.15 | 0.15 | 0.15 | 0.15 | 0.15 | 0.15 | 0.2 | 0.2 | 0.5 |

[a]Syloid 72.
[b]Igepal CO-630 available from GAF Corporation.
[c]Contains Tenopal AMS and Tenopal RBS available from Ciba Geigy.
[d]Ultramarine blue 5002 available from Whittaker Clark and Daniels.

TABLE IIIA

| | After 1 month @ 90° F./90% RH | |
|---|---|---|
| Composition | % $O_2$ Loss | % Cake |
| B-1 | 6 | 3 |
| B-2 | — | 1 |
| B-3 | 7 | 9 |
| B-4 | — | — |
| B-5 | 9 | 4 |
| B-6 | 8 | 1 |
| B-7 | — | — |
| B-8 | — | — |
| B-9 | — | 1 |
| B-10 | 4 | 4 |

— indicates no test

From the foregoing, it can be seen that the simple admixing of particulate siliceous material in appropriate quantities as well as the addition of corn starch, diethyl phthalate or mixtures thereof provide excellent stability for dry granular household laundry bleaches containing an alkali metal percarbonate.

It will be appreciated that various departures and modifications can be made to the foregoing methods and compositions by those knowledgeable in the art without departing from the spirit of our invention. Furthermore, our invention may comprise, consist of, or consist essentially of the hereinbefore recited procedures and materials.

What is claimed is:

1. A method for preventing caking and promoting flowability of a granular peroxygen bleaching and laundering composition which comprises adding to said composition corn starch, diethyl phthalate or mixtures thereof in an amount sufficient to reduce caking and promote flowability of said composition.

2. A method according to claim 1 wherein said composition comprises by weight 0 to 24 percent alkali metal perborate; 5 to 50 percent alkali metal percarbonate; 20 to 95 percent of an alkali metal carbonate, alkali metal sulfate, alkali metal chloride or mixtures thereof; and from about 0.05 to 1 percent corn starch, diethyl phthalate or mixtures thereof.

3. A dry granular peroxygen bleaching composition consisting essentially of by weight 0 to 24 percent alkali metal perborate; 5 to 50 percent alkali metal percarbonate; 20 to 95 percent of an alkali metal carbonate, alkali metal sulfate, alkali metal chloride or mixtures thereof; 0.1 to 2.0 percent of a particulate siliceous material selected from the group consisting of aluminum silicates, magnesium-aluminum silicates and amorphous silica; and 0.05 to 1.0 percent of corn starch, diethyl phthalate or mixtures thereof.

4. A composition according to claim 3 consisting essentially of 5 to 50 percent sodium percarbonate; 0 to 24 percent sodium perborate tetrahydrate; 20 to 95 percent of sodium carbonate, sodium sulfate, sodium chloride or mixtures thereof; 0.1 to 2.0 percent amorphous silica; and 0.05 to 1.0 percent corn starch, diethyl phthalate or mixtures thereof.

5. A composition according to claim 4 in which the amorphous silica is selected from the group consisting of silica gel, fumed silica and inorganic glass microspheres.

6. A composition according to claim 5 in which the amorphous silica is present in the amount 0.1 to 0.3 percent by weight.

7. A composition according to claim 3 in which corn starch is present in the amount of about 0.4 to 0.6 percent by weight.

8. A composition according to claim 3 in which diethyl phthalate is present in the amount of about 0.1 to 0.3 percent by weight.

9. A composition according to claim 3 containing a nonionic surfactant, fluorescent whitening agent, colorant, perfume or mixtures thereof.

10. A dry granular peroxygen bleaching composition consisting essentially of by weight 5 to 50 percent alkali metal percarbonate; 20 to 95 percent alkali metal carbonate, alkali metal sulfate, alkali metal chloride or mixtures thereof; and 0.1 to 2.0 of a particulate siliceous material selected from the group consisting of aluminum silicates, magnesium-aluminum silicates, and amorphous silica and 0.05 to 1.0 percent corn starch, diethyl phthalate or mixtures thereof.

11. A composition according to claim 10 consisting essentially of 5 to 50 percent sodium percarbonate; 20 to 95 percent sodium carbonate, sodium sulfate, sodium chloride or mixtures thereof; 0.1 to 2.0 percent amorphous silica; and 0.05 to 1.0 percent corn starch, diethyl phthalate or mixtures thereof.

12. A composition according to claim 13 in which the amorphous silica is selected from the group consisting of silica gel, fumed silica and inorganic glass microspheres.

13. A composition according to claim 12 in which the amorphous silica is present in the amount 0.1 to 0.3 percent by weight.

14. A composition according to claim 13 in which corn starch is present in the amount of about 0.4 to 0.6 percent by weight.

15. A composition according to claim 13 in which diethyl phthalate is present in the amount of about 0.1 to 0.3 percent by weight.

16. A composition according to claim 13 containing a nonionic surfactant, fluorescent whitening agent, colorant, perfume or mixtures thereof.

* * * * *